US012458097B2

(12) United States Patent
Coursimault

(10) Patent No.: US 12,458,097 B2
(45) Date of Patent: Nov. 4, 2025

(54) ADJUSTABLE HEADBAND FOR A PROTECTION HELMET AND PROTECTION HELMET COMPRISING ONE SUCH HEADBAND

(71) Applicant: ZEDEL, Crolles (FR)

(72) Inventor: Antoine Coursimault, Grenoble (FR)

(73) Assignee: ZEDEL, Crolles (FR)

( * ) Notice: Subject to any disclaimer, the term of this patent is extended or adjusted under 35 U.S.C. 154(b) by 168 days.

(21) Appl. No.: 17/979,510

(22) Filed: Nov. 2, 2022

(65) Prior Publication Data

US 2023/0133162 A1 May 4, 2023

(30) Foreign Application Priority Data

Nov. 2, 2021 (FR) ..... 2111638

(51) Int. Cl.
*A42B 3/14* (2006.01)
*A42B 3/08* (2006.01)

(52) U.S. Cl.
CPC ..... *A42B 3/145* (2013.01); *A42B 3/085* (2013.01)

(58) Field of Classification Search
CPC ..... A42B 3/145; A42B 3/085; A42B 3/04; A42B 3/324; A42B 3/14; A42B 3/142; A42B 3/147; A42B 3/08; A42B 1/22; A41F 1/00
See application file for complete search history.

(56) References Cited

U.S. PATENT DOCUMENTS

| | | | | |
|---|---|---|---|---|
| 2,503,432 | A * | 4/1950 | Bowers | A42B 3/145 600/242 |
| 5,373,588 | A | 12/1994 | Hede et al. | |
| 2011/0047679 | A1* | 3/2011 | Rogers | A42B 3/324 2/418 |
| 2015/0327617 | A1 | 11/2015 | Gaudillere | |
| 2019/0029355 | A1 | 1/2019 | Seo et al. | |
| 2019/0196536 | A1 | 6/2019 | Wang et al. | |
| 2020/0121014 | A1 | 4/2020 | King et al. | |
| 2022/0039502 | A1* | 2/2022 | Brose | A42B 3/142 |

FOREIGN PATENT DOCUMENTS

| | | | |
|---|---|---|---|
| EP | 0 558 427 | A1 | 9/1993 |
| KR | 2001-0096086 | A | 11/2001 |
| KR | 1020200143303 | A | 12/2020 |

* cited by examiner

*Primary Examiner* — Uyen T Nguyen
(74) *Attorney, Agent, or Firm* — Oliff PLC

(57) ABSTRACT

A headband for a protection helmet comprises a strip forming at least a part of a ring around a user's head. An adjustment device adjusts a circumference of the ring. The end of the strip is fixed to an attachment point that is movable with respect to the body of the adjustment device. A rotary actuator is connected to the adjustment device by means of a transmission so that rotation of the rotary actuator results in the attachment point being moved with respect to the body. The transmission comprises a flexible transmission shaft configured to transfer a rotary torque applied on the rotary actuator into a rotary torque applied on the adjustment device to move the attachment point and modify the circumference of the ring. A protection helmet comprises such headband.

10 Claims, 5 Drawing Sheets

ADJUSTABLE HEADBAND FOR A PROTECTION HELMET AND PROTECTION HELMET COMPRISING ONE SUCH HEADBAND

BACKGROUND OF THE INVENTION

The invention relates to an adjustable headband for a protection helmet and to a protection helmet provided with one such headband.

STATE OF THE ART

In a large number of fields and in particular for mountaineering and work at heights, it is common practice to use a helmet. To improve the ergonomics, it is commonplace to use a helmet that is equipped with an adjustable headband. Depending on the configurations, the headband is adjustable as regards its circumference or its shape.

It is known to manufacture helmets with an adjustable headband and more particularly with a circumference that is adjustable. The headband has one or two strips and an adjustment device to adjust the overlap length between the strips or the end of the strip. The document EP0558427 describes a helmet provided with a headband in the form of a ring with a system for adjusting the perimeter of the headband by means of a rack system fixed to the crown. The rack system enables the perimeter of the headband to be adjusted and also enables the front part and the occipital part of the headband to be moved with respect to the crown. This solution is complicated to implement and is expensive. This embodiment is attractive but imposes an adjustment by means of a plurality of predefined notches. The front portion of the headband and the rear portion of the headband can be adjusted differently.

The rack system also requires the rotary actuator to be located in the immediate proximity of the adjustment system to preserve a reasonable cost and volume as well as a good ruggedness.

It is also known to provide an adjustment device by means of a cord fixed to the crown. The cord is associated with a clamp, for example a tanka cord clamp, that will stretch the neckband part of the headband to adjust the circumference of the headband. The document US 2015/0327617 discloses a protection helmet provided with a neckband that can deform to fit the user's head size.

It is apparent that these configurations are not always very practical to use so that it appears necessary to improve the configuration of the headband.

SUMMARY OF THE INVENTION

One object of the invention consists in remedying these shortcomings, and more particularly in providing a headband that is easier to use than the prior art configurations.

These shortcomings tend to be overcome by means of a headband for a protection helmet for mountaineering and work at heights comprising:

- a ring designed to pass round a user's head;
- at least a first strip forming at least a part of the ring;
- a first adjustment device configured to adjust a circumference of the ring by moving one end of the first strip, the first adjustment device having a first body designed to be fixed to a crown;
- at least a main first attachment point, the end of the first strip being fixed to the main first attachment point, the main first attachment point being movable with respect to the first body to define the circumference of the ring;
- a first rotary actuator functionally connected to the first adjustment device by means of a first transmission so that rotation of the first rotary actuator results in movement of the main first attachment point with respect to the first body.

The headband is remarkable in that the first transmission comprises a flexible transmission shaft configured to transfer a rotary torque applied on the first rotary actuator into a rotary torque applied on the first adjustment device to move the main first attachment point and modify the circumference of the ring.

According to one feature of the invention, the flexible transmission shaft is chosen from a coil spring with spiral turns or a plurality of rigid shafts joined by a plurality of transmission joints.

In preferential manner, the transmission joints are joints with concurrent axes and preferentially universal joints or Rzeppa joints.

In a particular embodiment, the headband comprises:

- a second adjustment device configured to adjust a circumference of the ring by moving another end of the first strip, or one end of a second strip, the second adjustment device having a second body designed to be fixed to the crown;
- a second attachment point, the other end of the first strip or the end of the second strip being fixed to the second attachment point, the second attachment point being movable with respect to the second body to define the circumference of the ring.

The first rotary actuator is functionally connected to the second adjustment device by means of a second transmission so that rotation of the first rotary actuator results in movement of the second attachment point with respect to the second body, the second transmission comprising a flexible transmission shaft configured to transfer a rotary torque applied on the first rotary actuator into a rotary torque applied on the second adjustment device to move the second attachment point and modify the circumference of the ring.

Advantageously, a rear portion of the ring is a neckband that is fitted rotatable with respect to the first adjustment device and to the second adjustment device, the neckband being fitted rotatable around a first rotation shaft and a second rotation shaft formed by the first attachment point and the second attachment point.

In a particular embodiment, the first rotary actuator is fitted on the neckband.

Preferentially, the first adjustment device comprises a main first threaded section with a first thread and a main first nut, the main first nut and the main first threaded section forming a helical link, rotation of the first rotary actuator resulting in movement of the main first nut along the main first threaded section, at least one of the main first nut and the main first threaded section moving along a longitudinal axis of the main first threaded section and supporting the first attachment point.

In advantageous manner, a second strip forms at least a part of the ring. The first adjustment device has a first secondary threaded section with a second thread, a first secondary nut sliding along the first secondary threaded section, one end of the second strip being fixed to a secondary first attachment point supported by one of the first secondary nut and the first secondary threaded section.

Advantageously, the displacement length of the main first attachment point is different from the displacement length of the secondary first attachment point for a predefined rotation of the first rotary actuator.

It is a further object of the invention to provide a helmet comprising a crown and a headband according to one of the foregoing configurations, the headband being fixed to the crown.

DESCRIPTION OF THE DRAWINGS

Other advantages and features will become more clearly apparent from the following description of particular embodiments and implementation modes of the invention given for non-restrictive example purposes only and represented in the accompanying drawings, in which.

DETAILED DESCRIPTION

Figure 1:
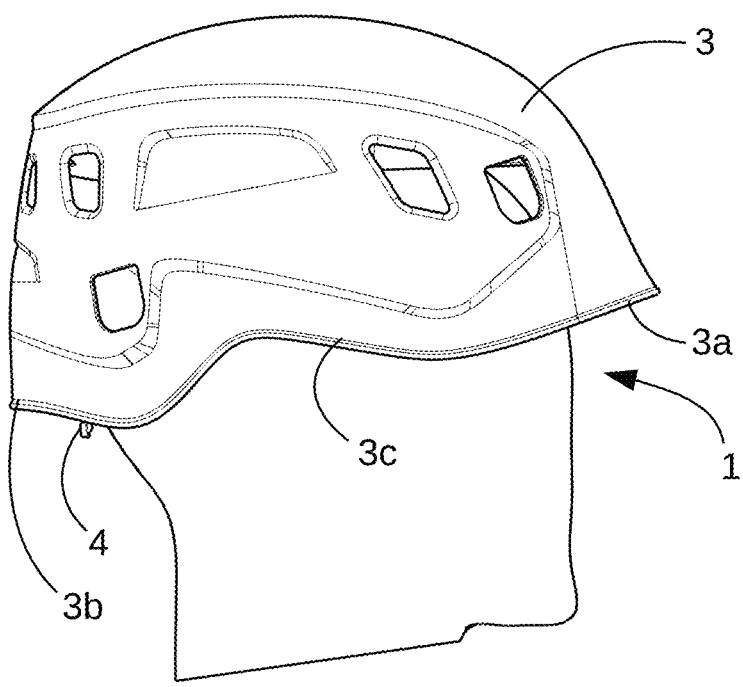
FIG. 1 schematically illustrates a side view of a helmet.
Figure 2:
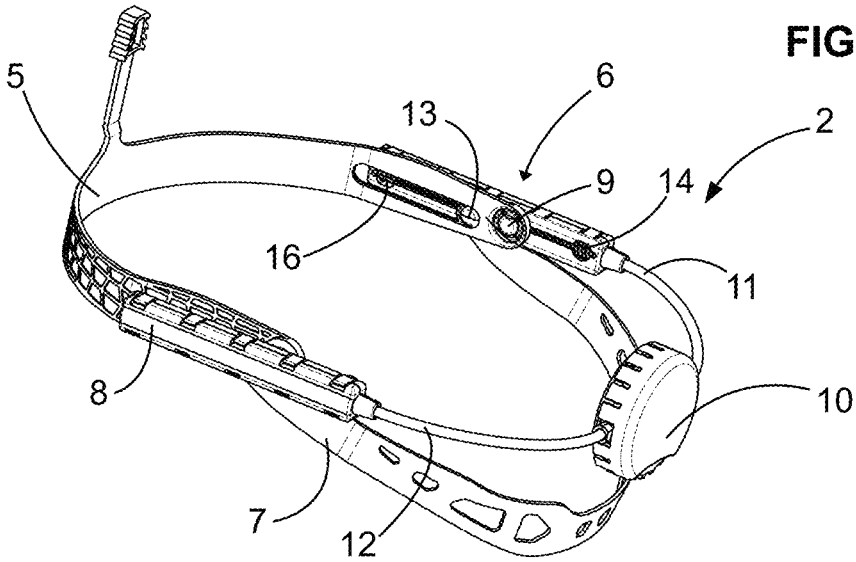
FIG. 2 schematically illustrates a perspective view of a headband.
Figure 3:
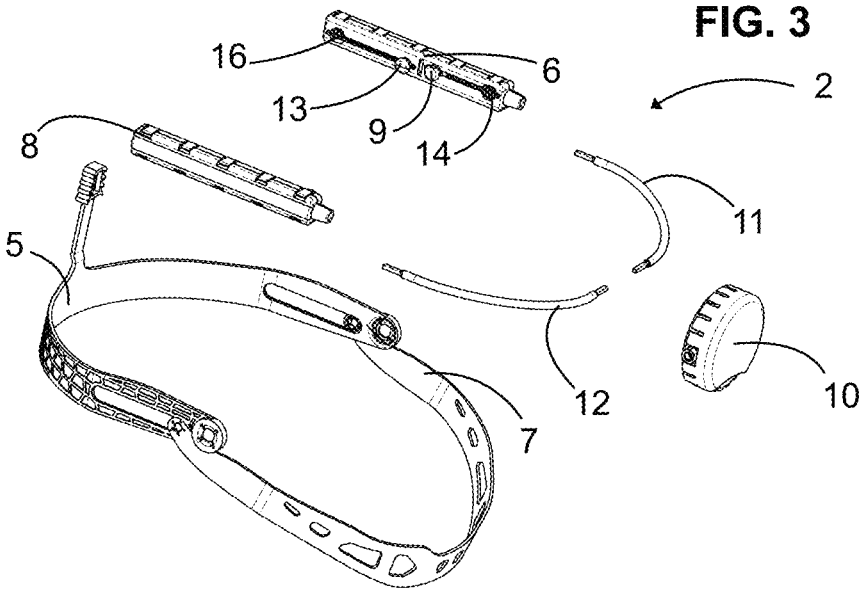
FIG. 3 schematically illustrates an exploded view of the headband represented in FIG. 2.

FIG. 1 represents a protection helmet 1 provided with a headband 2 that is adjustable as regards its circumference. FIGS. 2 and 3 represent a headband 2 in the form of a ring the circumference of which is adjustable.

The protection helmet 1 comprises a crown 3 made from a material that prevents the latter from folding onto itself. The crown 3 can preferentially be made from a plastic material, for example from injected polycarbonate or ABS or from polystyrene or from expanded polypropylene, or from any other plastic material, in particular from injected or thermoformed plastic or from foam.

The crown 3 comprises a front part 3*a* located at the front, i.e. close to the user's forehead, and an occipital part 3*b* located at the rear. Front part 3*a* is separated from occipital part 3*b* by two lateral parts 3*c* respectively right lateral part and left lateral part. The protection helmet 1 is provided with a headband 2 with a front portion and a rear portion. The rear portion can be a neckband 4. The headband 2 is fixed to the crown 3 so as to form a ring designed to surround the user's head.

The headband 2 has at least a first strip 5 and at least a first adjustment device 6. The first strip 5 forms at least a part of the ring. The first adjustment device 6 is configured to adjust the circumference of the ring. The first strip 5 is designed to come into contact with the head to press on the head and support the crown 3.

The headband 2 has one or more connectors that are configured to secure the headband 2 to the crown 3. The connection between the headband 2 and the crown 3 can be removable or unremovable. The connectors can define rigid connections or flexible connections between the headband 2 and the crown 3. Securing of the headband 2 with the crown 3 can be performed with only rigid connections, with only flexible connections or a mixture comprising one or more rigid connections and one or more flexible connections.

In the embodiment illustrated in FIGS. 2 and 3, the headband 2 has a first strip 5 and a second strip 7 and a first adjustment device 6 and a second adjustment device 8. The first adjustment device 6 and the second adjustment device 8 are configured to adjust the circumference of the ring. One of the first strip 5 and the second strip 7 forms all or part of neckband 4. Neckband 4 is fitted movable with respect to the crown 3 and to the front portion of the ring at least in a movement that is or is close to a rotation. In another embodiment, the ring is formed partly by the crown 3, for example the first strip 5 forms only the rear part of the ring. The user's forehead is still in contact with the front part of the crown 3 and adjustment of the circumference of the ring is performed by moving the first strip 5 that forms the rear part of the ring. As an alternative, the rear part of the ring is formed by the crown 3 and the front part of the ring is formed by the first strip 5.

Depending on the configurations, the first adjustment device 6 and the second adjustment device 8 can operate independently or not. In one configuration, the first adjustment device 6 and the second adjustment device 8 can act on the front part and the rear part of the ring during adjustment. As an alternative, one of the first adjustment device 6 and the second adjustment device 8 acts on the front part of the ring whereas the other one acts on the rear part of the ring. Depending on the configurations, the first adjustment device 6 and the second adjustment device 8 operate simultaneously or operate independently in time.

In one configuration, a single strip 5 is used and passes round the user's head with the first adjustment device 6. The first adjustment device 6 is fixed to at least one end of the first strip 5. In another configuration, several strips are used, preferably a first strip 5 and a second strip 7, as has been illustrated. The first adjustment device 6 moves the first strip 5 and the second strip 7 if applicable to modify the circumference of the ring.

The headband 2 has a main first attachment point 9 that is fitted movable with respect to a first body of the first adjustment device 6. The first body is fixed to the crown 3. The first body can be fitted fixedly secured to the crown 3 or movable with respect to the crown 3. The first body can be fixed to the crown 3 by means of a connector defining a flexible connection that preferably enables the distance separating the crown 3 and the first body to be modified. When the first adjustment device is configured to adjust the position of the front part and/or the rear part of the headband 2, i.e. an adjustment in the sagittal plane, the movable link enables the adjustment device to be moved in the frontal plane. The shape of the ring is better suited to match the shape of the head thereby procuring an enhanced comfort. FIG. 2 illustrates an embodiment of a flexible connection configured to secure the first strip 5 to the crown 3, here the front part of the crown 3. In the illustrated configuration, the flexible connection allows a movement in the sagittal plane and makes movement in the vertical direction difficult when the helmet is worn in the standing position.

The main first attachment point 9 is mounted movable with respect to the crown 3. The end of the first strip 5 is fixed to the main first attachment point 9. The end of the first strip 5 can be mounted removable or unremovable with respect to the main first attachment point 9. In the illustrated embodiment, the end of the first strip 5 defines a hole, preferably a through hole. The main first attachment point 9 is formed by a pin that inserts in the hole to secure the first end of the first strip 5 to the main first attachment point 9. An opposite configuration with the first end of the first strip 5 having a pin and a main first attachment point 9 defining a hole is possible. Another system for securing the first end of the first strip 5 to the main first attachment point 9 is also possible.

To modify the circumference of the ring, the headband 2 has a first rotary actuator 10 functionally connected to the first adjustment device 6 by means of a first transmission 11 so that rotation of the first rotary actuator 10 results in movement of the main first attachment point 9 with respect to the first body. The first rotary actuator 10 is actuated in rotation, i.e. it rotates around its axis of rotation, and rotation of the first rotary actuator 10 results in movement of the main first attachment point 9 and of the end of the first strip 5 with respect to the first body and with respect to the crown 3 to increase or reduce the circumference of the ring.

When used by a collective body, it is advantageous to provide for the first rotary actuator 10 to be located in a position that is easily accessible for the user and for a third party. It is advantageous for the first rotary actuator 10 to be located at a distance from the crown 3 or for it to be salient from the outside of the crown 3. Preferentially, the first rotary actuator 10 passes at least partially through the crown 3 or the first rotary actuator 10 is located outside the inner volume defined by the crown 3. FIGS. 2 and 3 illustrate a headband 2 having a first rotary actuator 10 designed to be salient from the rear part of the crown 3, preferentially in the mid-sagittal plane.

It is also advantageous to fix the first rotary actuator 10 on neckband 4. However, in order to facilitate storage of helmet 1, it is advantageous to be able to stow neckband 4 away in the inner volume of the crown 3. A configuration of the first adjustment device 6 is therefore sought for that does not impede rotation of neckband 4 between a use position where neckband 4 is pressing on the neck and a storage position where neckband 4 is stowed in the inner volume of the crown 3.

It is also advantageous to have a first rotary actuator 10 that is fitted movable with respect to the crown 3.

To be able to separate the first adjustment device 6 and the first rotary actuator 10 more easily, it is particularly advantageous to use a first transmission 11 that comprises a flexible transmission shaft configured to transfer a rotary torque applied on the first rotary actuator 10 into a rotary torque applied on the first adjustment device 6 to move the main first attachment point 9 and modify the circumference of the ring. The torque applied on the first rotary actuator 10 is applied on input of the first transmission 11 and this torque is retransmitted on output of the first transmission 11 to be applied on the first adjustment device 6.

This configuration is easier to use than an adjustment system associated with a first rotary actuator mounted on a rack.

The flexible transmission shaft of the first transmission 11 can follow the curvature of the crown 3 from the first rotary actuator fixed to the crown 3 up to the first adjustment device 6 fixed to the crown 3. This configuration enables the first rotary actuator 10 to be placed in a more convenient position for adjustment by a third party without reducing the sensitivity in terms of adjustment or the power transfer when adjustment is performed. The flexible transmission shaft makes it easier to adapt to a possible movement of the first adjustment device 6 with respect to the crown 3. The transmission shaft or drive shaft transfers a torque from one end to the opposite end.

Figure 5:
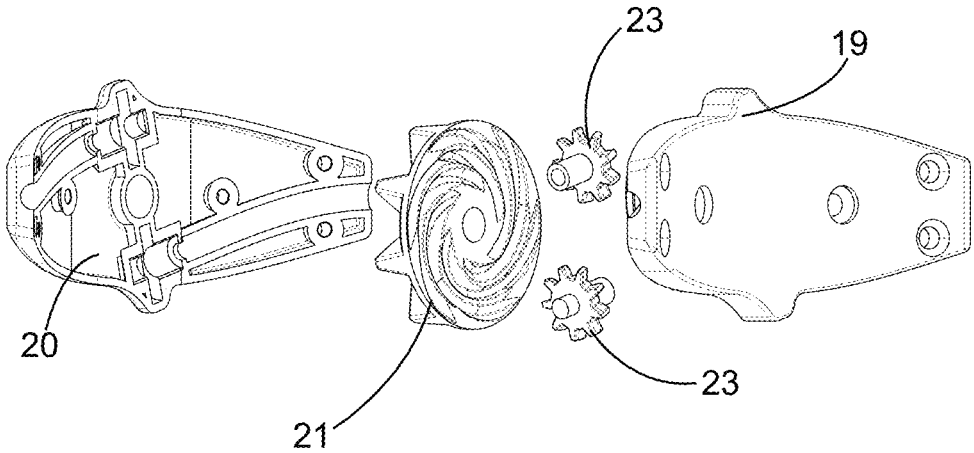
FIG. 5 schematically illustrates an exploded view of a first rotary actuator fitted on a neckband.
Figure 6:
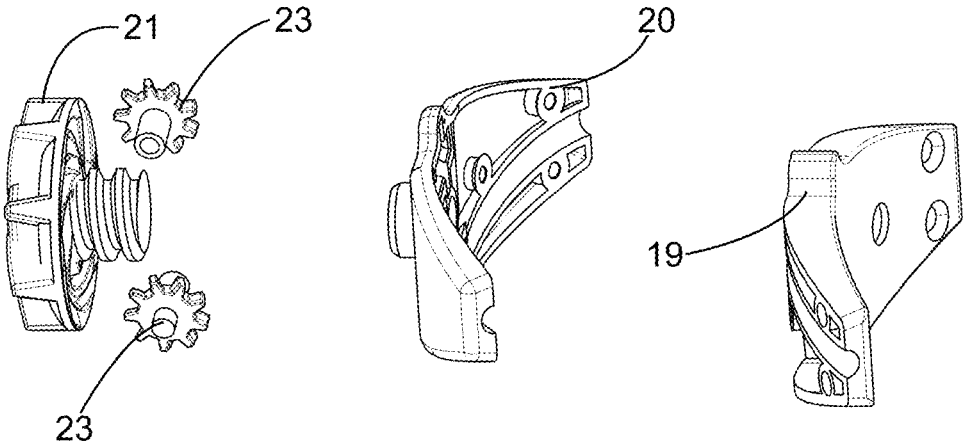
FIG. 6 schematically illustrates an exploded view of another embodiment of a first rotary actuator fitted on a neckband.

In an alternative embodiment illustrated in FIGS. 5 and 6, the first rotary actuator 10 is fixed to neckband 4 or forms part of neckband 4. Neckband 4 is fitted movable with respect to the crown 3 with a movement that is a rotation or that is close to a rotation. The first transmission 11 uses a flexible transmission shaft enabling the curvature of neckband 4 to be followed. The first transmission 11 does not impede stowing of neckband 4.

In preferential manner, the headband 2 has a second adjustment device 8 configured to adjust the circumference of the ring by moving another end of the first strip 5, or one end of a second strip 7. The second adjustment device 8 has a second body fixed to the crown 3. The use of the first adjustment device 6 and the second adjustment device 8 increases the amplitude of adjustment of the circumference of the headband 2 and/or reduces the bulk of each adjustment device. The second body can be mounted fixedly on the crown 3 or it can be mounted movable with respect to the crown 3. The fixed or movable configuration of the second body is independent from the configuration of the first body, preferably the two are identical.

When the headband 2 has a second main attachment point, it is advantageous for the other end of the first strip 5 or for the end of the second strip 7 to be fixed to second main attachment point. The second main attachment point is movable with respect to the second body and to the crown 3 to define the circumference of the ring.

In preferential manner, the first rotary actuator 10 is functionally connected to the second adjustment device 8 by means of a second transmission 12 so that rotation of the first rotary actuator 10 results in movement of the second main attachment point with respect to the second body. The second transmission 12 comprises a flexible transmission shaft configured to transfer a rotary torque applied on the first rotary actuator 10 into a rotary torque applied on the second adjustment device 8 to move the second main attachment point and modify the circumference of the ring. This embodiment is advantageous when the first adjustment device 6 and the second adjustment device 8 both act on the first strip 5 or on the first strip 5 and the second strip 7.

As an alternative, it is possible to use a first rotary actuator 10 and a second rotary actuator (not illustrated) that are respectively connected to the first adjustment device 6 and to the second adjustment device 8. This embodiment is advantageous when the first adjustment device 6 acts on the first strip 5 and the second adjustment device 8 acts on the second strip 7.

In a preferred embodiment, neckband 4 is fitted rotating around a first rotation shaft and a second rotation shaft that are respectively fixed to the main first attachment point 9 and to second main attachment point. In this particular case, it is advantageous for the two main attachment points to be connected to the first rotary actuator 10 and for them to move over the same distance when the first rotary actuator 10 performs a predefined rotation.

In preferential manner, the first adjustment device 6 is configured to move two first attachment points, i.e. the main first attachment point 9 and a secondary first attachment point 13. When the ring is formed by a single strip 5, the main first attachment points 9 and the secondary first attachment point 13 are respectively fixed to the two ends of the first strip 5, preferably fixedly secured to the ends. When the ring comprises the first strip 5 and the second strip 7, the first strip 5 is fixed to the main first attachment point 9 and the second strip 7 is fixed to the secondary first attachment point 13, preferably fixedly mounted. It is particularly advantageous for the headband 2 to have a first adjustment device 6 and a second adjustment device 8. It is even more advantageous for the first adjustment device 6 to have a main first attachment point 9 and a secondary first attachment point 13 and for the second adjustment device 8 to have a main second attachment point and a secondary second attachment point. The first strip 5 is fixed to main first attachment points 9 and the second strip 7 is fixed to secondary first attachment points 13, preferably fixedly mounted. If the adjustment devices have main attachment points and secondary attachment points, the rotation shaft of the neckband 4 can be a main attachment point or a secondary attachment point.

Different configurations are possible to form the first transmission 11 and the second transmission 12. The configuration of the second transmission 12 can be identical to or different from that of the first transmission 11.

Figure 9:
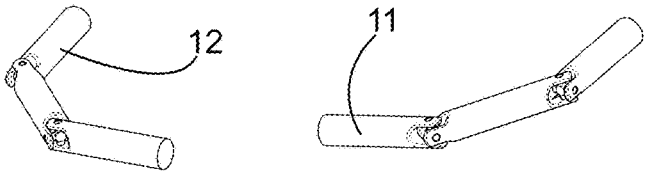
FIG. 9 schematically illustrates an embodiment of flexible transmissions.
Figure 10:
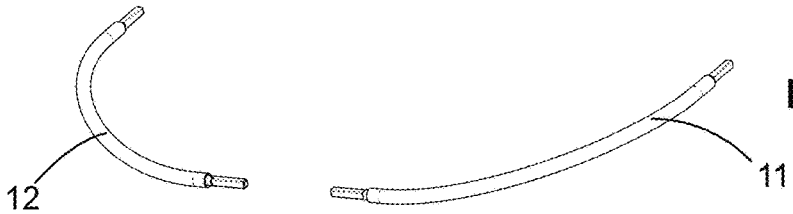
FIG. 10 schematically illustrates another embodiment of flexible transmissions.

The flexible transmission shaft is configured to transmit a rotary torque from one end of the shaft to the opposite end of the shaft, in one direction of rotation or in the opposite direction. The flexible transmission shaft can be formed by one or more parts. FIGS. 9 and 10 illustrate two different embodiments of the transmissions. In FIG. 9, the transmissions are in the form of a rigid shafts connected by universal joints to form two cardan transmissions. In FIG. 10, the transmissions are formed by coil springs, preferably springs with contiguous turns.

Figure 11:
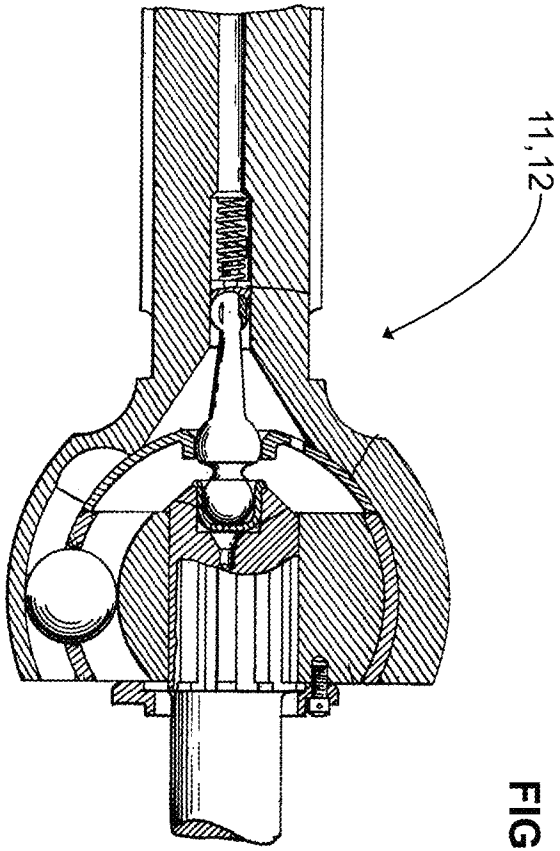
FIG. 11 schematically illustrates an Rzeppa joint.

The flexible transmission shaft can be chosen from a coil spring and a plurality of rigid elementary shafts connected by transmission joints. It is advantageous to use a transmission joint with concurrent axes and the latter is preferentially chosen from a universal joint, a Thompson constant velocity joint, a Tracta joint, a Rzeppa joint (FIG. 11) or a Malpezzi joint.

The use of a flexible transmission shaft in the first transmission 11 is particularly advantageous with a first adjustment device 6 that comprises a main first threaded section 14 with a first thread and a main first nut 15. The main first nut 15 and the main first threaded section 14 form a helical link called first main helical link. Rotation of the first rotary actuator 10 results in movement of the main first nut 15 along the main first threaded section 14, at least one of the main first nut 15 and the main first threaded section 14 moving along a longitudinal axis of the main first threaded section 14 and supporting the main first attachment point 9.

Rotation of the first rotary actuator 10 results in rotation of the first transmission 11 and in particular of the flexible transmission shaft. Rotation of the flexible transmission shaft results in rotation of at least one of the parts of the first main helical link resulting in translation of the main first attachment point 9 with respect to the first body and with respect to the crown 3.

In order to provide a more efficient adjustment of the circumference of the ring, it is preferable for the ring to comprise a first strip 5 and a second strip 7 and for the first adjustment device 6 to be provided with a main first threaded section 14 with a main first nut 15 and with a secondary first threaded section 16 with a secondary first nut 17.

The main first threaded section 14 and the main first nut 15 form a main first helical link. The secondary first threaded section 16 and the secondary first nut 17 form a secondary first helical link. The main first attachment point 9 is fixed to one of the parts of the main first helical link. The secondary first attachment point 13 is fixed to one of the parts of the secondary first spiral link.

In advantageous manner, the secondary first threaded section 16 has a second thread that has a different value from the value of the first thread of the main first threaded section 14. Preferentially, the difference between the threads is chosen to keep the mid-sagittal plane of the crown 3 coinciding with the mid-sagittal plane of the user thereby keeping the crown 3 well-centred.

In the illustrated configurations, the first strip 5 is fixed to the main first nut 15 and to the second main nut. The second strip 7 is fixed to the first secondary nut 17 and to the second secondary nut.

Figure 7:
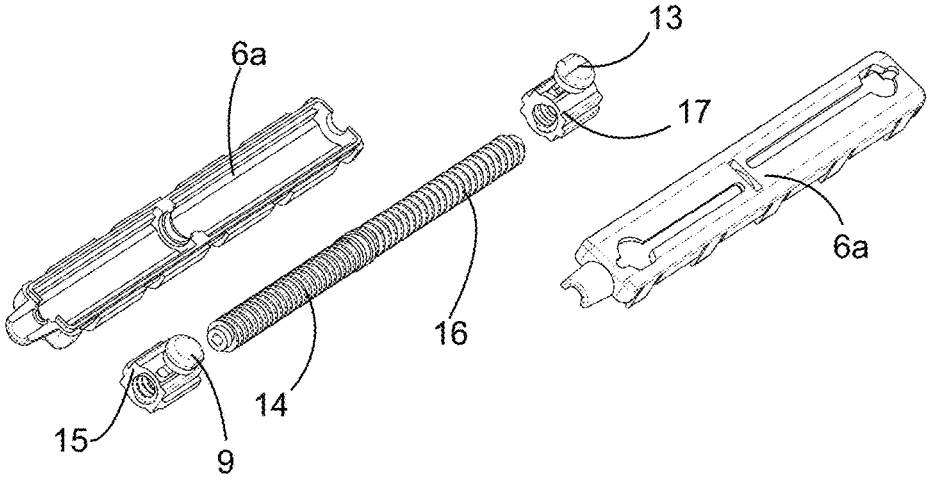
FIG. 7 schematically illustrates an exploded view of a first adjustment device.

In the configuration illustrated in the FIG. 7, the main first threaded section 14 and the secondary first threaded section 16 belong to the same threaded rod. The threaded rod is held securedly in a body formed by two shells 6*a*. One of shells 6*a* defines two apertures for the main first attachment point 9 and the secondary first attachment point 13 to pass through. Other embodiments are possible.

Figure 8:
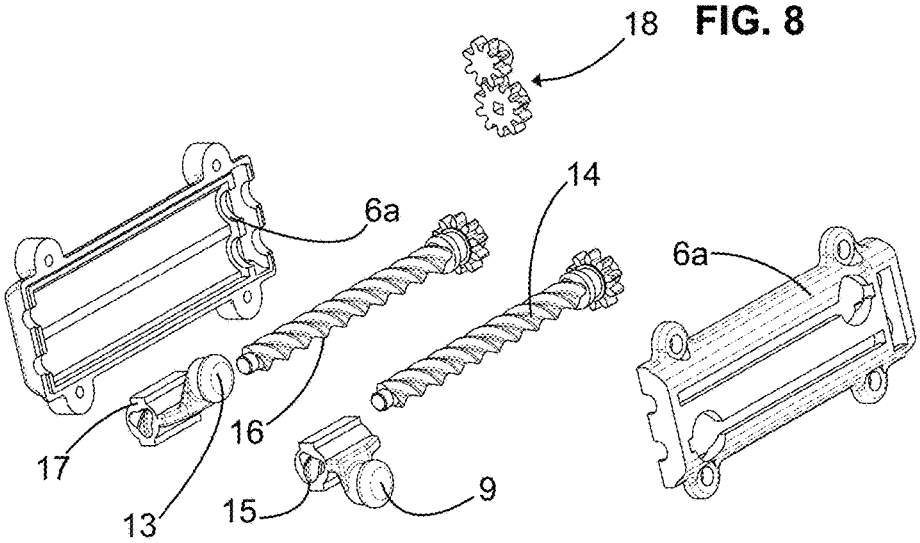
FIG. 8 schematically illustrates an exploded view of another embodiment of a first adjustment device.

In an alternative embodiment illustrated in FIG. 8, the main first threaded section 14 belongs to a main first threaded rod and the secondary first threaded section 16 belongs to a secondary first threaded rod. The main first threaded rod is mechanically connected to the secondary first threaded rod by an additional transmission 18 configured in such a way that rotation of the main first threaded rod causes simultaneous rotation of the secondary first threaded rod. In the illustrated example, the main first threaded rod is connected to the secondary first threaded rod by a gear mechanism. Preferentially, the gear mechanism modifies the speed of rotation of the main first threaded rod with respect to the speed of rotation of the secondary first threaded rod. This makes it possible to have different travel speeds between the main first attachment point 9 and the secondary first attachment point 13. The same can be the case for the second main attachment point and the second secondary attachment point.

Preferentially, a second adjustment device 8 is used provided with a main second threaded portion and advantageously a secondary second threaded portion. The main second threaded portion is associated with a second main nut to form a second main helical link. If it is present, the secondary second threaded portion is associated with a second secondary nut to form a second secondary helical link.

It is advantageous to install the first adjustment device 6 and the second adjustment device 8 as a right adjustment device and a left adjustment device. The use of two adjustment devices enables the extent of modification of the circumference to be increased and/or the size of each adjustment device to be reduced. It is then easier to integrate the adjustment device inside the volume delineated by the crown 3.

In particularly advantageous manner, the second threaded rod has a main second threaded section with a first thread and a secondary second threaded section with a second thread. The values of the first threads are preferentially identical and the same can be the case for the second threads.

In preferential manner, the main first nut 15 is a front first nut sliding along the main first threaded section 14 to adjust the front portion of the ring. The secondary first nut 17 is a rear first nut sliding along the secondary first threaded section 16 to adjust the rear portion of the ring.

In the illustrated embodiments, the first rotary actuator 10 is mounted rotatable around a rotation axis that is perpendicular or substantially perpendicular to the wall of the crown 3 close its attachment point. This configuration enables the first rotary actuator to be more easily integrated in the inner volume of the helmet delineated by the crown 3 or salient from the outer wall of the crown 3. This configuration enables the perimeter of the headband 2 to be more easily adjusted when the helmet is worn without having to change the configuration of the crown 3.

Figure 4:
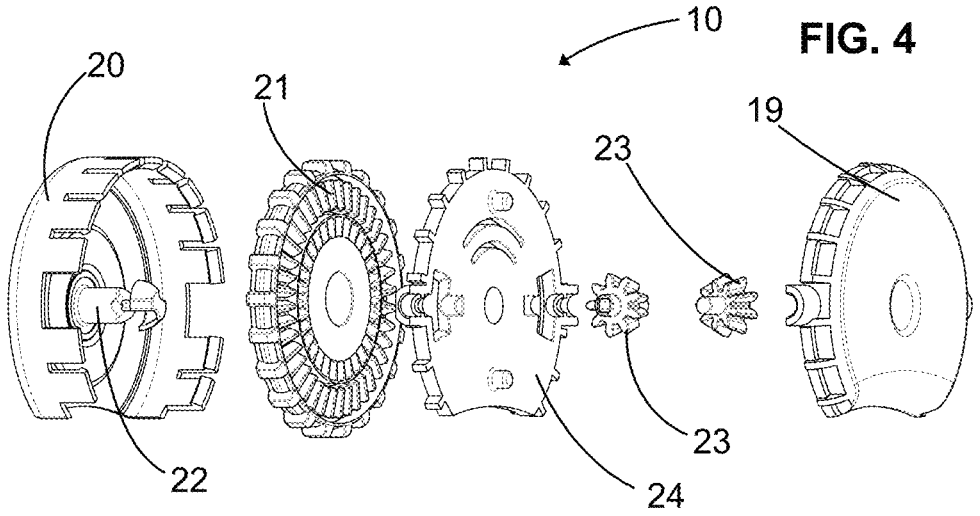
FIG. 4 schematically illustrates an exploded view of the first rotary actuator.

FIG. 4 illustrates a particular configuration of the first rotary actuator 10 that has two outputs and that is configured to make the first transmission 11 and the second transmission 12 rotate. The first rotary actuator 10 has a support 19 and a cover 20 that define a cavity receiving a first toothed wheel 21. The first toothed wheel 21 is mounted rotatable around a rotation shaft 22. The first toothed wheel 21 is salient from a part of the cavity so that the user is able to make the first toothed wheel 21 rotate inside the cavity. The teeth of the first toothed wheel 21 are arranged on a main surface and engage in two second toothed wheels 23 that have a rotation axis perpendicular or substantially perpendicular to the rotation axis of the first toothed wheel 21. The teeth of the first toothed wheel 21 are arranged radially.

The two second toothed wheels 23 are housed in two receptacles of an intermediate support 24 that is fixedly mounted in the cavity. Rotation of the first toothed wheel 21 causes rotation of the two second toothed wheels 23. One of the two second toothed wheels 23 is fixed to the first transmission 11. The other of the second toothed wheels 23 is fixed to the second transmission 12. A configuration with a single second toothed wheel 23 can be used if desired to supply one transmission only. Second toothed wheels 23 are preferentially conical or in the shape of a truncated cone to form a conical gear.

The incline of the rotation axis of second toothed wheels main first threaded with respect to the rotation axis of the first toothed wheel 21 can vary according to the incline required for the end of the first transmission 11 and of the second transmission 12. This embodiment is particularly designed to be integrated on or in the crown 3 of helmet 1. An enlargement of the support 19 and of the cover 20 is possible to form a terminal part of a neckband 4 designed to come into contact with the neck.

The embodiments illustrated in FIGS. 5 and 6 correspond to two other configurations of a first rotary actuator 10. In these particular embodiments, the support 19 and the cover 20 are more elongate and more curved to better match the shape of the neck. The support 19 and the cover 20 define the rotation axis of the first toothed wheel 21. The first toothed wheel 21 is mounted salient from the cover 20. The support 19 and the cover 20 define the two rotation axes of the two second toothed wheels main first threaded. The two second toothed wheels main first threaded are fixed to first transmission 11 and to the second transmission 12. The two second wheels main first threaded are mounted rotating between the cover 20 and the support 19. The teeth of second toothed wheels main first threaded pass through the cover to engage with the teeth of the first toothed wheel 21. The first toothed wheel 21 defines teeth in the form of a spiral that cooperate with second toothed wheels with straight teeth. A large number of other configurations are possible.

In the illustrated embodiments, each adjustment device has a body that is mounted fixedly on the crown 3 by means of a connector defining a rigid connection.

The invention claimed is:

1. Headband for a protection helmet comprising:

a ring designed to surround a user's head;

at least a first strip forming at least a part of the ring;

a first adjustment device configured to adjust a circumference of the ring by moving one end of the first strip, the first adjustment device having a first body designed to be fixed to a crown of the protection helmet and comprising a main first threaded section with a first thread and a main first nut, the main first nut and the main first threaded section forming a helical link;

at least a main first attachment point, the end of the first strip being fixed to the main first attachment point, the main first attachment point being movable with respect to the first body to define the circumference of the ring, at least one of the main first nut and the main first threaded section moving along a longitudinal axis of the main first threaded section and supporting the main first attachment point to move the main first attachment point with respect to the first body; and a first flexible transmission shaft having a first end connected to a first rotary actuator and a second end connected to the first adjustment device, the first flexible transmission shaft extending from the first body to connect the first rotary actuator, the main first nut moving within the first body, wherein rotation of the first rotary actuator results in movement of the main first nut along the main first threaded section and in movement of the main first attachment point with respect to the first body; and wherein a rotary torque applied on the first rotary actuator generates a rotary torque applied on the first adjustment device moving the main first attachment point and modifying the circumference of the ring.

2. The headband according to claim 1 wherein the first flexible transmission shaft is chosen from a coil spring with spiral turns or a plurality of rigid shafts joined by one or a plurality of transmission joints.

3. The headband according to claim 2 wherein the first flexible transmission shaft is the plurality of rigid shafts joined by the one or the plurality of transmission joints, the transmission joints being joints with concurrent axes.

4. The headband according to claim 3 wherein the transmission joints are chosen from universal joints or Rzeppa joints.

5. The headband according to claim 1 comprising:

a second adjustment device configured to adjust the circumference of the ring by moving another end of the first strip, or one end of a second strip forming at least a part of the ring, the second adjustment device having a second body designed to be fixed to the crown;

a main second attachment point, the other end of the first strip or the end of the second strip being fixed to the main second attachment point, the main second attachment point being movable with respect to the second body to define the circumference of the ring; and wherein the first rotary actuator is functionally connected to the second adjustment device by means of a second transmission so that rotation of the first rotary actuator results in movement of the main second attachment point with respect to the second body, the second transmission comprising a second flexible transmission shaft transferring a rotary torque applied on the first rotary actuator into a rotary torque applied on the second adjustment device to move the main second attachment point and modify the circumference of the ring.

6. The headband according to claim 5 wherein a rear portion of the ring is a neckband that is fitted rotatable with respect to the first adjustment device and to the second adjustment device, the neckband being fitted rotatable around a first rotation shaft and a second rotation shaft formed by the main first attachment point and the main second attachment point.

7. The headband according to claim 6 wherein the first rotary actuator is fitted on the neckband.

8. The headband according to claim 1 comprising a second strip forming at least a part of the ring and wherein the first adjustment device has a secondary first threaded section with a second thread, a secondary first nut sliding along the secondary first threaded section, one end of the second strip being fixed to a secondary first attachment point supported by one of the secondary first nut and the secondary first threaded section.

9. The headband according to claim 8 wherein a displacement length of the main first attachment point is different from a displacement length of the secondary first attachment point for a predefined rotation of the first rotary actuator.

10. Protection helmet comprising a crown and a headband according to claim 1, the headband being fixed to the crown.

* * * * *